US005088896A

United States Patent [19]

Nielsen et al.

[11] Patent Number: 5,088,896

[45] Date of Patent: Feb. 18, 1992

[54] JET PUMP WITH ROTATABLE VENTURI CARTRIDGE

[75] Inventors: Darryl M. Nielsen, Lenexa; Dorothy D. McDaniel, Leawood, both of Kans.

[73] Assignee: The Marley Company, Mission Woods, Kans.

[21] Appl. No.: 726,848

[22] Filed: Jul. 8, 1991

Related U.S. Application Data

[63] Continuation of Ser. No. 535,392, Jun. 8, 1990, abandoned.

[51] Int. Cl.[5] ..... F04F 5/02

[52] U.S. Cl. ..... 417/178; 417/77; 417/80; 417/89

[58] Field of Search ..... 417/77, 78, 80, 89, 417/151, 178, 198, 68, 69

[56] References Cited

U.S. PATENT DOCUMENTS 3,481,529 12/1969 Mugele ..... 417/69

*Primary Examiner*—Richard A. Bertsch
*Assistant Examiner*—Michael I. Kocharov
*Attorney, Agent, or Firm*—Kokjer, Kircher, Bowman & Johnson

[57] ABSTRACT

A jet pump having a rotatable venturi cartridge to permit any of several different sized venturi tubes to be aligned with a nozzle in the pump casing. A knob is provided on the pump casing to permit convenient rotation of the venturi cartridge. Printed indicia on the knob align with an indicator arrow to visually indicate the setting of the knob.

14 Claims, 2 Drawing Sheets

JET PUMP WITH ROTATABLE VENTURI CARTRIDGE

This is a continuation of application Ser. No. 07/535,392, filed Jun. 8, 1990, now abandoned.

BACKGROUND AND SUMMARY OF THE INVENTION

This invention relates generally to the field of pumps and more particularly to a jet pump having a nozzle-venturi tube combination that can be quickly and easily changed to achieve different pumping characteristics.

In the operation of jet pumps, part of the liquid is passed through a nozzle in order to create a low pressure area on the downstream side of the nozzle which assists in drawing liquid into the suction side of the pump. By varying the nozzle-venturi combination, different pumping characteristics can be provided. For example, the flow rate can be increased with a resultant lower pressure, or the pressure can be increased with a resulting lower volume rate of flow.

In the past, pumps have been provided with a nozzle-venturi unit which can be removed and replaced with different nozzle-venturi units that have smaller or larger venturi tubes in order to achieve different flow rates and pressures. An alternative arrangement has permitted either the nozzle or venturi tube or both to be separately removed and replaced. The problem with either type of arrangement is that considerable inconvenience is encountered in effecting the replacement of one component with another. First, the component that is to be installed must be located and the old component must be removed before the new one can be installed. Aside from the problems of storing the loose components that are not in use so that they are available when needed, this procedure requires assembly and disassembly operations that involve considerable time and difficulty, especially in situations where changeover between different components takes place with some frequency.

Accordingly, it is evident that there is a need for a jet pump in which the nozzle-venturi tube combination can be quickly and easily changed. It is the principal goal of the present invention to meet that need.

In accordance with the invention, a rotatable venturi cartridge is provided in the casing of a jet pump, and the cartridge includes different venturi tubes which are arranged in a circular pattern about the axis of rotation. The cartridge can be turned to align the different venturi tubes with a nozzle mounted in the pump casing. A knob which is mounted on the exterior of the pump at a conveniently accessible location is coupled with the venturi cartridge so that the knob can be turned to change the cartridge. Indicator marks o the knob provide a clear visual indication of the operating mode of the pump at each setting of the knob (i.e., a low, medium or high flow rate or the horsepower rating at the particular knob setting).

The overall result is that the pump characteristics can be changed as desired simply by turning the adjustment knob, in contrast to the considerable inconvenience that has been encountered in the past in order to change the nozzle-venturi tube combination. The advantages of the present invention are also achieved without adding appreciably to the cost of the pump and without adding significantly to the maintenance requirements.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
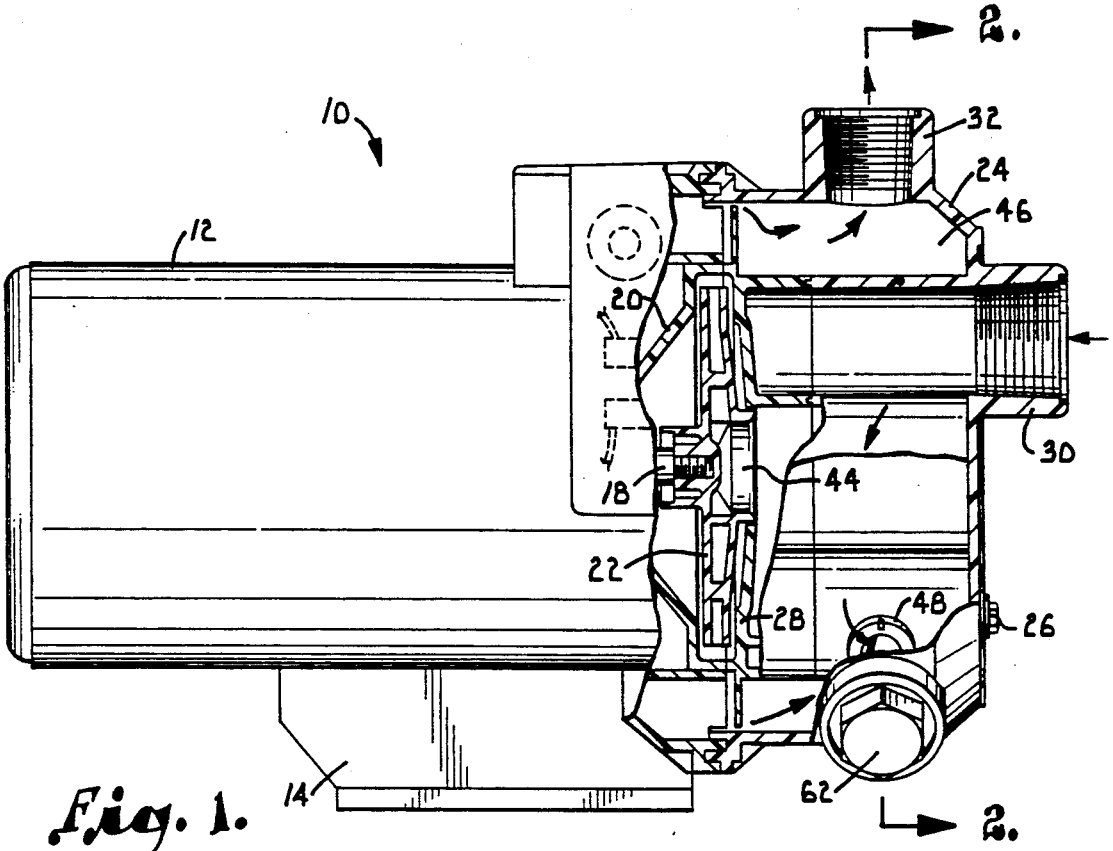
FIG. 1 is a side elevational view of a jet pump which is equipped with a rotatable venturi cartridge in accordance with a preferred embodiment of the present invention, with portions broken away for purposes of illustration.

Referring now to the drawings in more detail and initially to FIG. 1 in particular, numeral 10 generally designates a jet pump constructed according to a preferred embodiment of the present invention. The jet pump 10 is driven by a conventional electrical motor 12 mounted on a base 14 and having a control box which contains electrical terminals, lead wires and other components (not shown). The motor 12 drives an output shaft 18 which extends through a bracket 20 and carries a pump impeller 22 which is rotated by the shaft 18 when the motor 12 is energized.

The impeller 22 is enclosed in a pump casing 24 which is secured to bracket 20 by a plurality of screws 26. A diffuser cover 28 is located adjacent to the forward face of the impeller 22 and is adhesively or otherwise secured to the pump casing 24. The pump casing 24 has an internally threaded inlet 30 on its forward face for receiving water or other liquid which is to be pumped. An internally threaded outlet 32 is provided on top of the pump casing for discharging the liquid that is pumped.

Figure 2:
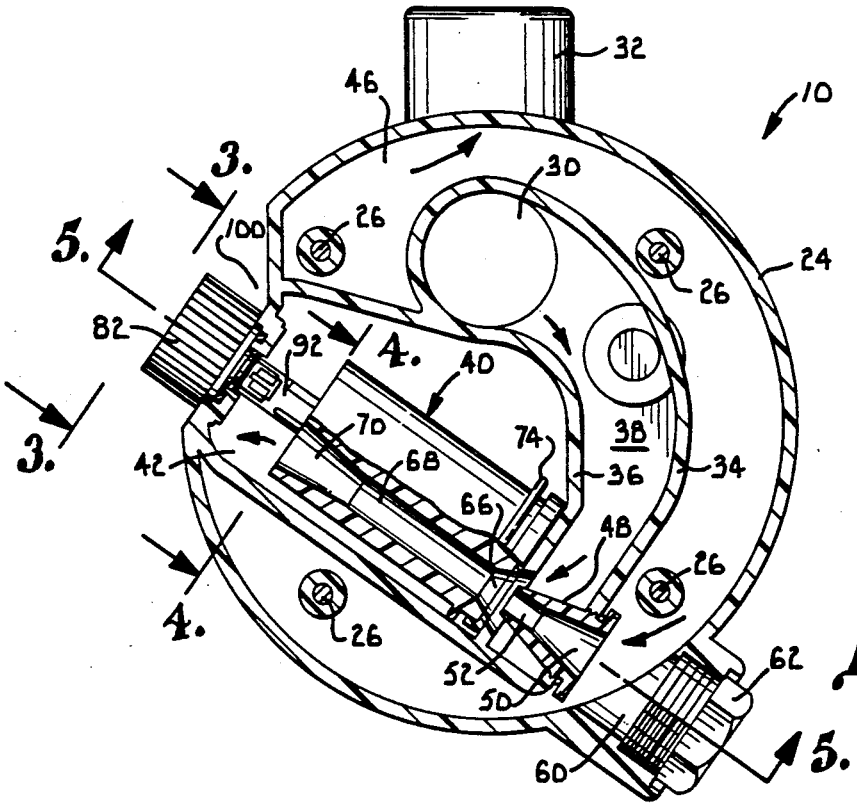
FIG. 2 is a fragmentary sectional view on an enlarged scale taken generally along line 2—2 of FIG. 1 in the direction of the arrows, with portions broken away for purposes of illustration.

With additional reference to FIG. 2 in particular, internal ribs 34 and 36 in the pump casing 24 define a flow passage 38 which extends from the pump inlet 30. A rotatable venturi cartridge which is generally identified by numeral 40 accommodates flow from the passage 38 to a chamber 42. The chamber 42 communicates with a central opening 44 in the impeller 22 (see FIG. 1), and the liquid that is drawn into the opening 44 is slung outwardly by the impeller 22 and flows past the diffuser vanes in bracket 20 into a chamber 46 which connects with the pump outlet 32.

Figure 5:
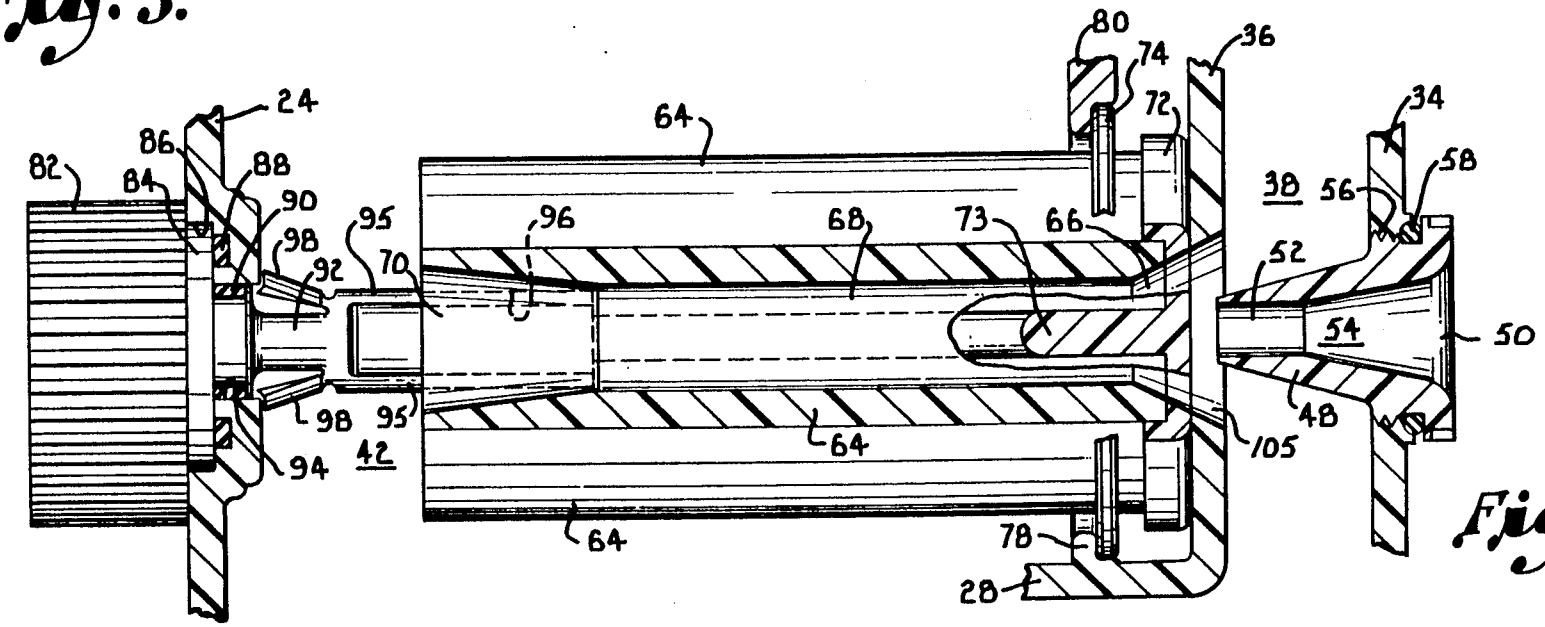
FIG. 5 is a fragmentary sectional view on an enlarged scale taken generally along line 5—5 of FIG. 2 in the direction of the arrows, with portions broken away for purposes of illustration.

Mounted in the pump casing 24 to the rib 34 is a converging nozzle 48 having an inlet or mouth 50 which opens into the chamber 46. The nozzle 48 has a restricted outlet end 52 which communicates with the passage 38 at a location adjacent to the inlet side of the venturi cartridge 40. As best shown in FIG. 5, the mouth or inlet 50 of the nozzle is flared, and the nozzle has a passage 54 which tapers from the flared mouth 50 to the restricted outlet 52. The exterior surface of the nozzle 48 is threaded at 56 so that the nozzle can be threaded into and out of a threaded opening in the rib 34. An O-ring 58 provides a seal between the rib 34 and a flange which is formed on the inlet end of the nozzle.

As best shown in FIG. 2, the nozzle 48 is located immediately inside of a drain port 60 which is formed in the lower part of the pump casing 24. A drain plug 62 is threaded into the drain port 60 in order to normally close it. The plug 62 can be threaded out of the drain port, and access is then provided to the nozzle 48 to permit it to be inspected or replaced with another nozzle having the same or a different size and/or configuration.

The venturi cartridge 40 includes three different venturi tubes 64 (see FIG. 4 in particular) which differ in diameter but are of the same general configuration. The venturi cartridge 40 is supported for rotation about a rotational axis that is equidistant from the longitudinal axes of the three venturi tubes 64. As best shown in FIG. 5, each venturi tube 64 has a converging inlet end 66, a restricted diameter throat 68 which extends the majority of the length of the tube, and a diverging outlet 70 from which the liquid flowing through the tube is discharged into chamber 42. The three venturi tubes 64 extend parallel to one another on the cartridge 40 and are arranged in a circular pattern such that each tube 64 can be selectively positioned in alignment with the nozzle 48 when the tube is rotated into an operative position by rotating the cartridge 40.

Figure 4:
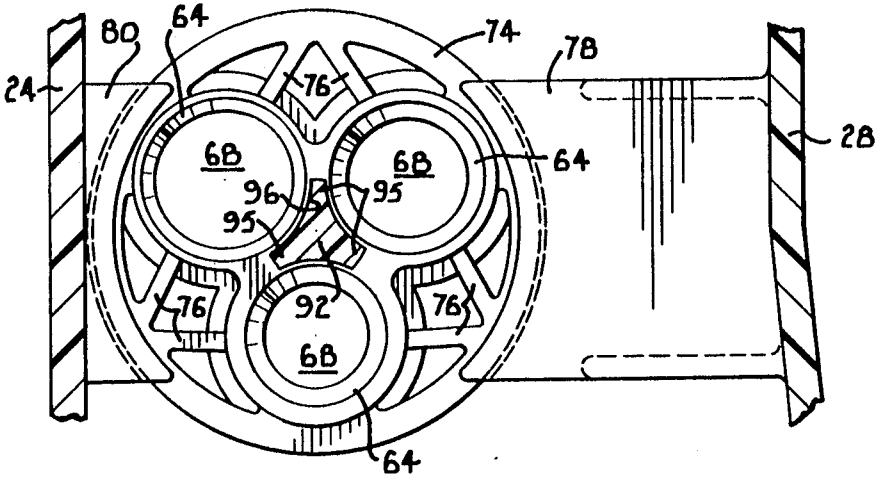
FIG. 4 is a fragmentary sectional view on an enlarged scale taken generally along line 4—4 of FIG. 2 in the direction of the arrows.

With reference to FIGS. 4 and 5 in particular, the base end of the venturi cartridge 40 is provided with a boot 72 which is disposed on the rib 36. The boot 72 has a projecting stub shaft 73 which is received in a passage in the cartridge 40 and which is coaxial with the rotational axis of the cartridge. The body of the cartridge 40 is provided with a circular flange 74 at location spaced from the boot 72. A plurality of thin fingers 76 (FIG. 4) connect the flange 74 with the body of the venturi cartridge 40. The flange 74 rides beneath the curved edge of a guide plate 78 which projects from the diffuser cover 28 and also fits in a stepped curved edge of another guide plate 80 which projects from the front wall of the pump casing 24. By virtue of this arrangement, the cartridge 40 is restricted to rotational movement about the cartridge rotational axis which coincides with the axis of the stub shaft 73.

Figure 3:
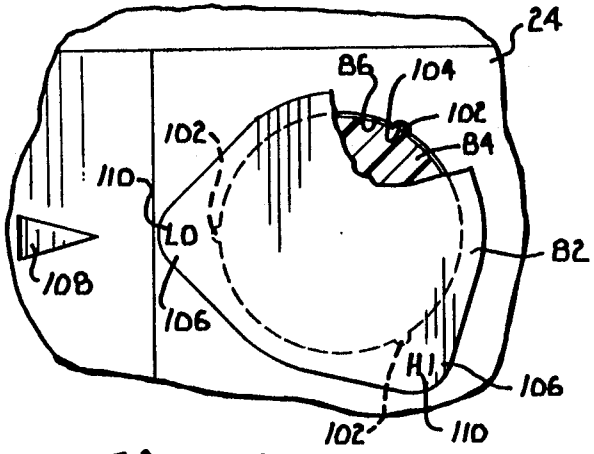
FIG. 3 is a fragmentary view on an enlarged scale taken generally along line 3—3 of FIG. 2 in the direction of the arrows, with a portion of the knob broken away for purposes of illustration.

Rotation of the venturi cartridge 40 is effected by turning a knurled knob 82 which is mounted on the exterior of the pump casing 24 at a readily accessible location. As best shown in FIGS. 3 and 5, the knob 82 is provided with a circular collar 84 which fits closely in a complemental circular recess 86 formed in the wall of the pump casing 24. The collar 84 compresses an O-ring 88 to provide a seal between the knob mechanism and the pump casing. A further seal is provided by another O-ring 90 which fits closely around a shaft 92 which extends from the collar 84 into the pump casing through an opening 94. As best shown in FIG. 4, the shaft 92 is provided with radially projecting ribs 95 which fit closely in a socket 96 having a shape complemental to that of the ribs and extending into the venturi cartridge 40. The close fit of the ribs 95 in the socket 96 effects a connection between the knob 82 and the cartridge 40 such that turning of the knob results in corresponding turning of the cartridge 40. It is noted that the knob 82 is centered on the rotational axis of the cartridge. A plurality of fingers 98 project from the shaft 92 and expand beneath the interior pump casing wall in order to hold the knob 82 in place against the exterior surface of the pump casing. Preferably, the knob 82 is located in a recess 100 (see FIG. 2) formed in the pump casing.

The cartridge adjustment mechanism is provided with a detent arrangement which releasably retains the cartridge 40 in three different positions, with the respective venturi tubes 64 being aligned with nozzle 48 in the three different positions. As best shown in FIG. 3, the detent includes three buttons 102 which project radially from the collar 84 and are spaced equidistantly at 120° intervals. The buttons 102 fit in notches 104 which are formed in the wall of the recess 86. The buttons 102 and notches 104 are located such that a detent position is established each time one of the venturi tubes 64 is aligned with the nozzle 48.

The outlet end 52 of nozzle 48 is adjacent to and aligned with a tapered opening 105 (FIG. 5) which extends through rib 34 and the cartridge boot 72. The opening 105 aligns with the inlet 66 of the venturi tube 64 that is in the operative position, and the taper of opening 105 matches the taper of the inlet 66.

With continued reference to FIG. 3 in particular, means are provided for visually indicating the setting of the knob 82 and thus which of the venturi tubes 64 is in the operating position in alignment with nozzle 48. The knob 82 has three lobes 106 which correspond with the locations of the buttons 102. An indicating arrow 108 is imprinted on the exterior of the pump casing at a location to align with one of the lobes 106 at each detent position of the knob. Each lobe 106 is provided with printing 110 which differs from the printing applied to the other lobes. For example, one of the lobes may be provided with the indication "LO" (low flow rate), another lobe may be provided with the indication "HI" (high flow rate) and the third lobe may be provided with the indication "MED" (medium flow rate). Thus, when the lobe with the "LO" indication is aligned with the indicator 108, a visual indication is provided that the cartridge is in the low flow rate setting.

Alternatively, the lobes may be provided with other indications, including the pump horsepower rating at the corresponding knob setting.

In operation of the pump, the impeller 22 is rotated by the electric motor 12 to cause water or other liquid to be drawn into the inlet 30 and drawn through passage 38 and the venturi tube which is in the operative position forming part of the liquid flow path. The liquid is discharged from the venturi tube into chamber 42 and is pulled by the impeller into chamber 46 and then out through the outlet 32. Some of the liquid in chamber 46 passes through the nozzle 48, and the effect of the nozzle is to accelerate the liquid passing through it to create a relatively low pressure in passage 38 adjacent to the nozzle outlet 52. The low pressure region results in the drawing of liquid into the inlet 30 and subsequent passage to the outlet 32.

The pumping characteristics of the pump 10 can be quickly and easily varied simply by rotating the knob 82 to a different position wherein a different one of the venturi tubes 64 is in the operating position in alignment with the nozzle 48. Because each venturi tube has a different size, the volume rate of flow that is pumped and the pressure will vary when different tubes are in the operating position. Accordingly, the user can select which pumping characteristics are desired depending upon the application in which the pump is to be used. The visual indication provided by the indicator arrow 108 and the printed indicia 110 allows the user to quickly note the setting of the knob 82.

The drain plug 62 can be removed both to drain the liquid from the pump casing and also to provide access to the nozzle 48. The nozzle can be unthreaded from the rib 34 and replaced with another nozzle having a different size and/or configuration in order to provide different pumping characteristics. Access is also provided for cleaning of the nozzle when clogged.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a jet pump having a casing presenting a pump inlet and a pump outlet and a driven impeller rotatable about a first axis for effecting a pressure differential between the pump inlet and outlet to pump liquid therebetween, the improvement comprising:

a converging nozzle disposed to pass liquid therethrough, said nozzle tapering from an inlet thereof to a restricted outlet thereof and having said outlet communicating with the pump inlet to effect a pressure reduction on the outlet side of the nozzle upon flow of liquid therethrough;

venturi means providing a flow path for liquid between the pump inlet and pump outlet substantially perpendicular to the first axis, said venturi means having a plurality of different venturi tubes each having a converging inlet, a restricted throat and a diverging outlet with the throats of the respective venturi tubes having different diameters;

means for mounting said venturi means in the casing in a manner permitting each venturi tube to be selectively aligned with said outlet of the nozzle in an operative position wherein the aligned tube provides said flow path; and means accessible from the exterior of the pump for effecting selective alignment of each venturi tube with said nozzle.

2. The improvement of claim 1, wherein:

said venturi means comprises a venturi cartridge carrying said venturi tubes thereon; and said mounting means comprises means for mounting said cartridge for rotation in the casing along a rotary path carrying the venturi tubes into successive alignment with said nozzle.

3. The improvement of claim 2, wherein said means accessible from the exterior of the pump comprises a knob on the exterior of the casing coupled with said cartridge in a manner to effect rotation thereof when the knob is turned.

4. The improvement of claim 3, including means associated with said knob for visually indicating which venturi tube is aligned with said nozzle.

5. The improvement of claim 1, including means for visually indicating which venturi tube is aligned with said nozzle.

6. A jet pump comprising:

a pump casing having a pump inlet for receiving incoming liquid and a pump outlet for discharging liquid;

an impeller in the pump casing and rotatable about a first axis;

drive means for driving said impeller about said axis to effect a pressure differential between the pump inlet and outlet to effect pumping of liquid therebetween along a main flow path;

a converging nozzle in the pump casing tapering from an inlet thereof to a restricted outlet thereof, said inlet being disposed to receive liquid at a relatively high pressure and said outlet communicating with the pump inlet to effect a pressure reduction when liquid passes through the nozzle;

a venturi cartridge having a plurality of venturi tubes each extending substantially perpendicular to said axis and having a converging inlet end, a restricted throat and a diverging outlet end, each venturi tube having a throat diameter different from the throat diameters of the other venturi tubes;

means for mounting said cartridge in the pump casing for movement along a presaribed path carrying said venturi tubes into successive alignment with the outlet of said nozzle with the aligned tube forming part of the flow path; and means on the exterior of the pump casing for effecting selective movement of said cartridge along said prescribed path.

7. The jet pump of claim 6, wherein said mounting means comprises means for mounting said cartridge for rotation along said prescribed path about a rotational axis, each tube having a center displaced from said rotational axis the same distance as the other tubes.

8. The jet pump of claim 7, wherein said means on the exterior of the pump casing comprises a knob coupled with said cartridge in a manner to effect rotation thereof when the knob is turned.

9. The jet pump of claim 8, including means associated with said knob for visually indicating which venturi tube is aligned with said nozzle.

10. The jet pump of claim 6, including means for visually indicating which veturi tube is aligned with said nozzle.

11. The jet pump of claim 6, including detent means for releasably retaining said cartridge at a plurality of positions corresponding to positions of alignment between the venturi tubes and nozzle.

12. In a jet pump of the type having a pump casing presenting a pump inlet and a pump outlet and a driven impeller rotatable about a first axis for effecting a pressure differential between the pump inlet and pump outlet to pump liquid therebetween, the improvement comprising:

a nozzle fixed in the pump casing and having an inlet disposed to receive liquid at a relatively high pressure, said nozzle tapering from said inlet thereof to an outlet thereof to effect a pressure reduction at said outlet of the nozzle at a location communicating with the pump inlet;

a venturi cartridge having a plurality of venturi tubes each extending substantially perpendicular to the axis and having a converging inlet end, a restricted throat and a diverging outlet end, said throats having different diameters and said cartridge being mounted in the pump casing for rotation along a path carrying said venturi tubes successively into alignment with the outlet of said nozzle to receive liquid for passage to the pump outlet; and a knob on the exterior of the pump casing coupled with said cartridge in a manner to effect rotation of the cartridge when the knob is turned.

13. The improvement of claim 12, including releasable detent means for retaining said cartridge at positions wherein the venturi tubes are aligned with said nozzle.

14. The improvement of claim 12, including means for visually indicating which venturi tube is aligned with said nozzle.

* * * * *